US008784044B2

(12) United States Patent
Durocher et al.

(10) Patent No.: US 8,784,044 B2
(45) Date of Patent: Jul. 22, 2014

(54) TURBINE SHROUD SEGMENT

(75) Inventors: Eric Durocher, Vercheres (CA); Guy Lefebvre, Saint-Bruno (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 503 days.

(21) Appl. No.: 13/222,013

(22) Filed: Aug. 31, 2011

(65) Prior Publication Data

US 2013/0052007 A1 Feb. 28, 2013

(51) Int. Cl.
*F01D 11/08* (2006.01)

(52) U.S. Cl.
USPC ..... 415/173.3; 29/527.1; 164/80; 164/111; 164/112

(58) Field of Classification Search
CPC ..... F01D 25/28; F01D 25/285; F01D 11/08; F01D 11/12; F01D 11/127; F04D 29/60; F04D 29/601; F04D 29/64; F05D 2230/22; F05D 2230/23; B22D 17/00; B22D 19/00; B22D 19/04; B22D 23/06; F16J 15/328
USPC ..... 415/213.1, 173.1, 173.5, 174.5; 164/80, 164/98, 111, 112, 113; 29/889.2, 527.1
See application file for complete search history.

(56) References Cited

U.S. PATENT DOCUMENTS 3,095,138 A * 6/1963 Warnken ..... 416/190
3,831,258 A 8/1974 Elbert et al.
4,137,619 A 2/1979 Beltran et al.
4,383,854 A 5/1983 Dembowski et al.
4,604,780 A 8/1986 Metcalfe
4,871,621 A 10/1989 Bagley et al.
5,010,050 A 4/1991 Wullenweber et al.
5,130,084 A 7/1992 Matheny et al.
5,553,999 A 9/1996 Proctor et al.
5,574,957 A 11/1996 Barnard et al.
5,772,748 A 6/1998 Hubbard
5,933,699 A 8/1999 Ritter et al.
5,950,063 A 9/1999 Hens et al.
6,102,656 A 8/2000 Nissley et al.
6,217,282 B1 4/2001 Stanka
6,350,404 B1 2/2002 Li et al.
6,679,680 B2 1/2004 Um et al.
6,709,771 B2 3/2004 Allister
6,857,848 B2 2/2005 Fokine et al.
6,874,562 B2 4/2005 Knott et al.
6,910,854 B2 6/2005 Joslin
7,029,228 B2 4/2006 Chan et al.
7,052,241 B2 5/2006 Decker
7,114,920 B2 10/2006 Synnott
7,128,522 B2 10/2006 Jutras
7,175,387 B2 2/2007 Kreis et al.
7,217,081 B2 5/2007 Scheurlen et al.
7,234,920 B2 6/2007 Imbourg et al.

(Continued)

*Primary Examiner* — Edward Look
*Assistant Examiner* — William Grigos
(74) *Attorney, Agent, or Firm* — Norton Rose Fulbright Canada LLP

(57) ABSTRACT

A turbine shroud segment is metal injection molded (MIM) about a core to provide a composite structure. In one aspect, the core is held in position in an injection mold and then the MIM material is injected in the mold to form the body of the shroud segment about the core. Any suitable combination of materials can be used for the core and the MIM shroud body, each material selected for its own characteristics. The core may be imbedded in the shroud platform to provide a multi-layered reinforced platform, which may offer resistance against crack propagation.

16 Claims, 4 Drawing Sheets

(56) References Cited

U.S. PATENT DOCUMENTS

| | | | | |
|---|---|---|---|---|
| 7,407,622 | B2 | 8/2008 | Voice et al. | |
| 7,687,021 | B2 * | 3/2010 | Imbourg et al. | 419/8 |
| 7,857,581 | B2 | 12/2010 | Mons et al. | |
| 7,875,340 | B2 | 1/2011 | Cho et al. | |
| 2005/0214156 | A1 | 9/2005 | Troitski et al. | |
| 2011/0033331 | A1 | 2/2011 | Tuppen et al. | |
| 2012/0186768 | A1 | 7/2012 | Sun et al. | |
| 2013/0136582 | A1 * | 5/2013 | Mizokami et al. | 415/173.1 |

* cited by examiner

TURBINE SHROUD SEGMENT

TECHNICAL FIELD

The application relates generally to the field of gas turbine engines, and more particularly, to turbine shroud segments.

BACKGROUND OF THE ART

Turbine shroud segments are typically made using a forged ring or casting of a selected material. Premature cracking through the shroud platform of such shroud segments have been observed. If the cracking is severe enough, the crack will propagate thicknesswise through the platform from the hot gas path surface to the cold back side surface thereof. This will result in loss of pressure margin in the vicinity of the crack. The loss of pressure margin may result in hot gas ingestion or adversely affect the turbine shroud cooling flow, thereby leading to irremediable material damages and turbine shroud failure.

There is thus a need to provide improvement.

SUMMARY

In one aspect, there is provided a turbine shroud segment for a turbine shroud of a gas turbine engine; comprising a metal injection molded (MIM) shroud body, said MIM shroud body including a platform having a hot gas path side surface and a back side surface, the platform being axially defined from a leading edge to a trailing edge in a direction from an upstream position to a downstream position of a hot gas flow passing through the turbine shroud, and being circumferentially defined between opposite lateral sides of the platform, and forward and aft hooks extending from the back side surface of the platform, said forward and aft hooks being axially spaced-apart from each other; and a core imbedded in the MIM shroud body, said core having a platform reinforcing section extending longitudinally along a circumferential direction of the platform between said hot gas path and back side surfaces.

In a second aspect, there is provided a method of manufacturing a turbine shroud segment for a gas turbine engine, the method comprising: providing a metallic core; holding the metallic core in position in a metal injection mold; and metal injection molding (MIM) a shroud segment body about the metallic core to form a composite metallic component, including injecting a metal powder mixture into the injection mold to imbed the metallic core into the shroud segment body and subjecting the composite component to debinding and sintering operations.

In a third aspect, there is provided a shroud segment for a turbine shroud of a gas turbine engine, comprising a reinforced platform having a hot gas path side and a back side, the reinforced platform being axially defined from a leading edge to a trailing edge in a direction from an upstream position to a downstream position of a hot gas flow passing through a turbine section of the gas turbine engine, and being circumferentially defined between opposite lateral sides of the reinforced platform, the reinforced platform having a multilayer construction including an intermediate reinforcing layer comprising a sheet metal insert imbedded within the platform between said hot gas path side and back side.

DESCRIPTION OF THE DRAWINGS

Reference is now made to the accompanying figures, in which.

DETAILED DESCRIPTION

Figure 1:
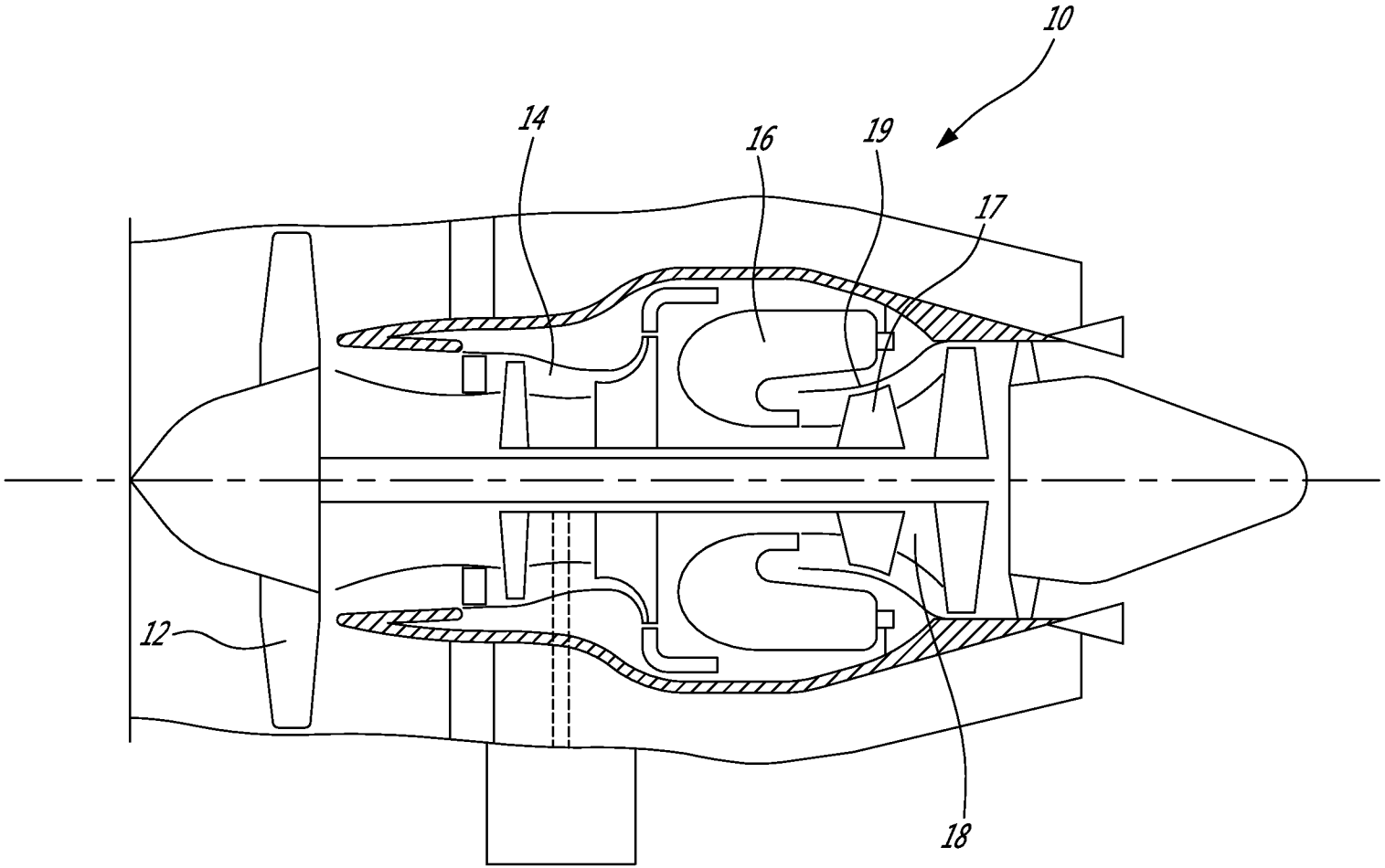
FIG. 1 is a schematic cross-section view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2A:
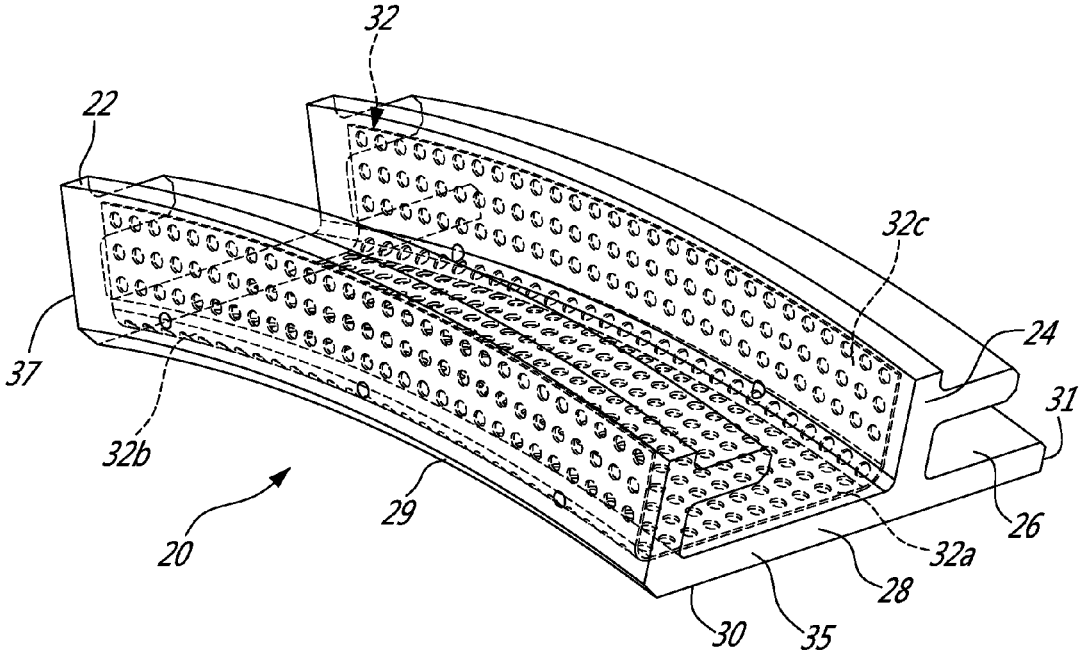
FIG. 2*a* is an isometric view of a metal injected molded (MIM) turbine shroud segment having a metallic core imbedded therein in accordance with one aspect of the present application.
Figure 2B:
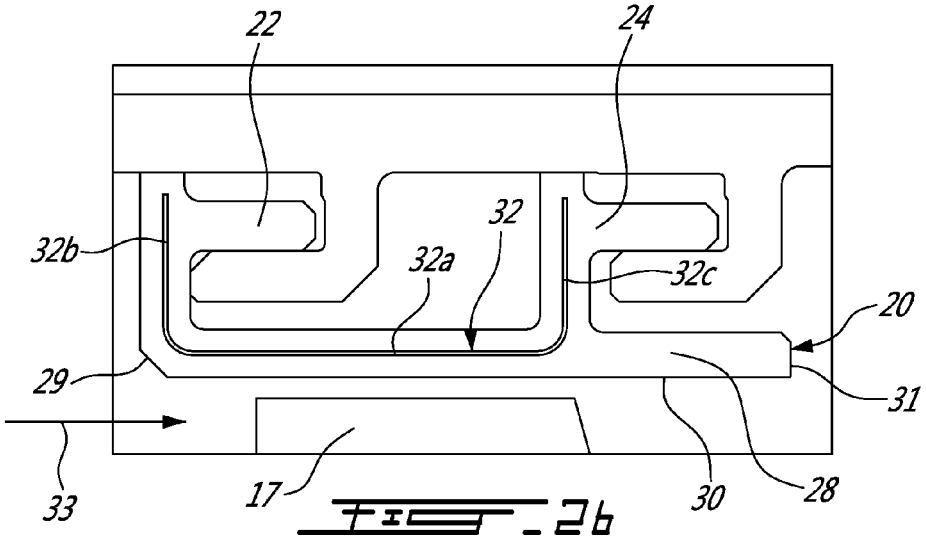
FIG. 2*b* is a cross-section of the turbine shroud segment shown in FIG. 2*a* and illustrating the metallic core imbedded in the MIM body of the shroud segment.

The turbine section 18 generally comprises one or more stages of rotor blades 17 extending radially outwardly from respective rotor disks, with the blade tips being disposed closely adjacent to an annular turbine shroud 19 supported from the engine casing. The turbine shroud 19 is typically circumferentially segmented. FIGS. 2*a* and 2*b* illustrate an example of one such turbine shroud segments 20. As will be seen hereinafter, the shroud segment 20 combines two or more materials, each having its own characteristics, in order to provide a composite component having mechanical properties that would otherwise be impossible or difficult to obtain from a single base material.

As shown in FIGS. 2*a* and 2*b*, the shroud segment 20 comprises axially spaced-apart forward and aft hooks 22 and 24 extending radially outwardly from a back side or cold radially outer surface 26 of an arcuate platform 28. The platform 28 has an opposite radially inner hot gas flow surface 30 adapted to be disposed adjacent to the tip of the turbine blades 17 (see FIG. 2*b*). The platform 28 is axially defined from a leading edge 29 to a trailing edge 31 in a direction from an upstream position to a downstream position of a hot gas flow (see arrow 33 in FIG. 2*b*) passing through the turbine shroud, and being circumferentially and longitudinally defined between opposite lateral sides 35, 37 (see FIG. 2*a*).

As can be appreciated from FIGS. 2*a* and 2*b*, an insert or core 32 is integrated/imbedded into the body of the shroud segment 20. In the illustrated example, the core 32 extends longitudinally through the platform 28 and into the forward and aft hooks 22 and 24 to provide a reinforced platform which provided added resistance to crack propagation. As will be seen hereinafter, the core 32 may be integrated into the shroud segment 20 by metal injection molding (MIM) the body of the shroud segment 20 about the core 32. The core may be provided in the form of a metallic reinforcement imbedded into the MIM material in such a manner that the two materials act together in resisting forces. As opposed to casting, the MIM process can be conducted at temperatures which are well below the melting point of the metallic material selected for the core 32 and as such the shroud body can be molded about a metallic core without compromising the integrity of the latter. This would not be possible with a conventional casting process where the temperature of the molten metal is over the meting point during the pouring operation. Any metallic insert placed in the casting mold would be damaged by the molten metal poured in the casting mold.

Figure 3:
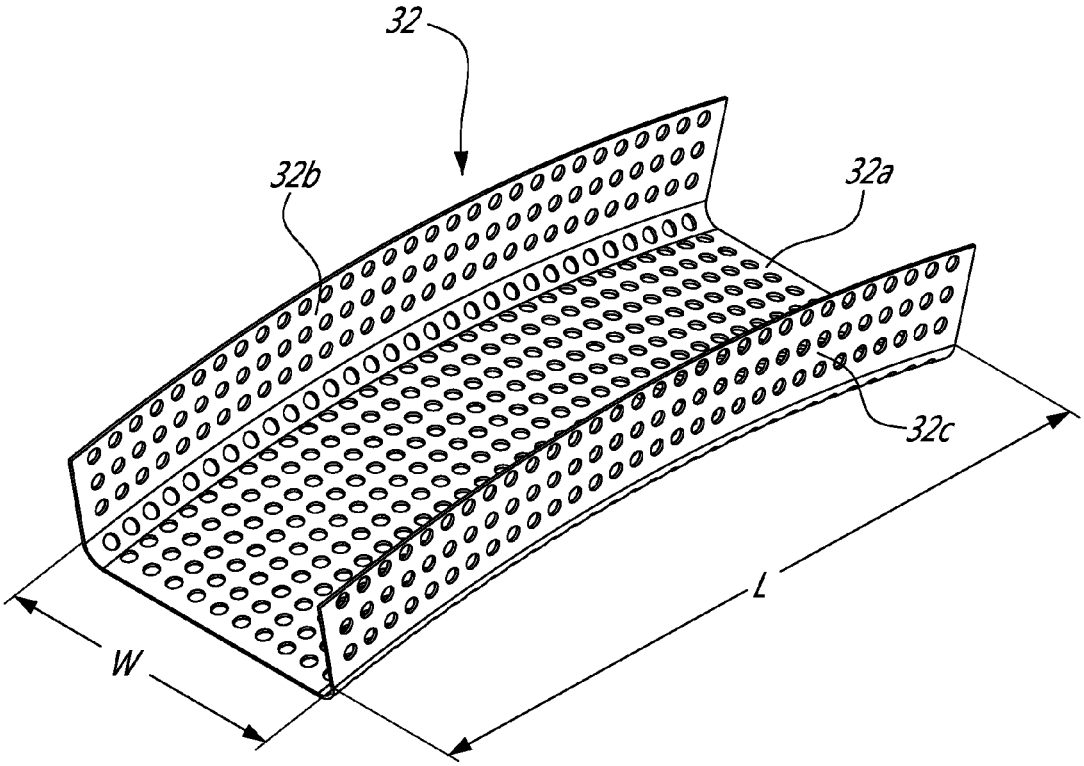
FIG. 3 is an isometric view of a perforated/mesh sheet metal embodiment of the metallic core.

As shown in FIG. 3, the core 32 may be made of sheet metal. The sheet metal may be perforated to provide for better anchoring of the core 32 into the MIM body of the shroud segment 20. The core 32 may be preformed before conducting the MIM process by cutting a length of sheet metal and stamping it or otherwise forming it into shape. As shown in FIG. 3, the opposed longitudinal sides of the piece of sheet metal core may be bent to form an elongated channel member having a generally U-shaped section, including forward and aft legs interconnected by a web portion. The elongated channel member is also bent along its length L to substantially follow the curvature of the platform 28 of the shroud segment 20 along the circumferential direction. The length L of the so formed elongated channel member is selected to generally correspond to that of the platform 28 of the shroud segment 20 in the circumferential direction. The width W of the elongated channel member is selected to generally correspond to the center-to-center distance between the forward and aft hooks 22 and 24 of the shroud segment 20. As shown in FIG. 2*b*, the sheet metal core 32 is thus shaped and configured to be generally centrally disposed in the platform 28 and forward and aft hooks 22 and 24 of the MIM body of the shroud segment 20. Again referring to FIG. 2*b*, it can be said that the illustrated sheet metal core 32 has a platform reinforcing section 32*a* spanning the platform 28 between the forward and an aft hooks 22 and 24, and forward and aft hook reinforcing sections 32*b* and 32*c* extending respectively into the forward and aft hooks 22 and 24 of the shroud segment 20. However, it is understood that the core 32 may adopt other configurations. For instance, the core 32 could be provided in the form of a generally planar or flat reinforcing strip, plate or layer extending only through the platform 28.

The core 32 may be made from a wide variety of materials. For instance, the core 32 could be made from Nickel or Cobalt alloys (e.g.: IN625, X-750, IN718, Haynes 188). The core material is selected for its mechanical properties (e.g. Young Modulus, UTS, Yield Strength, and maximum temperature usage). The selected material must also be able to withstand the pressures and temperatures inside the mold during the MIM process as well as the temperatures to which the MIM part is subject during the debinding and sintering operations. The core could also be machined from bar stock or a forged ring. The core material does not need to be the same as the MIM material. However, it may help to use the same material so as to maximize bonding and minimize chance of delamination. Selection of core material must be done to ensure material microstructure of core material is not affected during sintering operation and also ensure material properties of core material stay within material specification limits.

Figure 4:
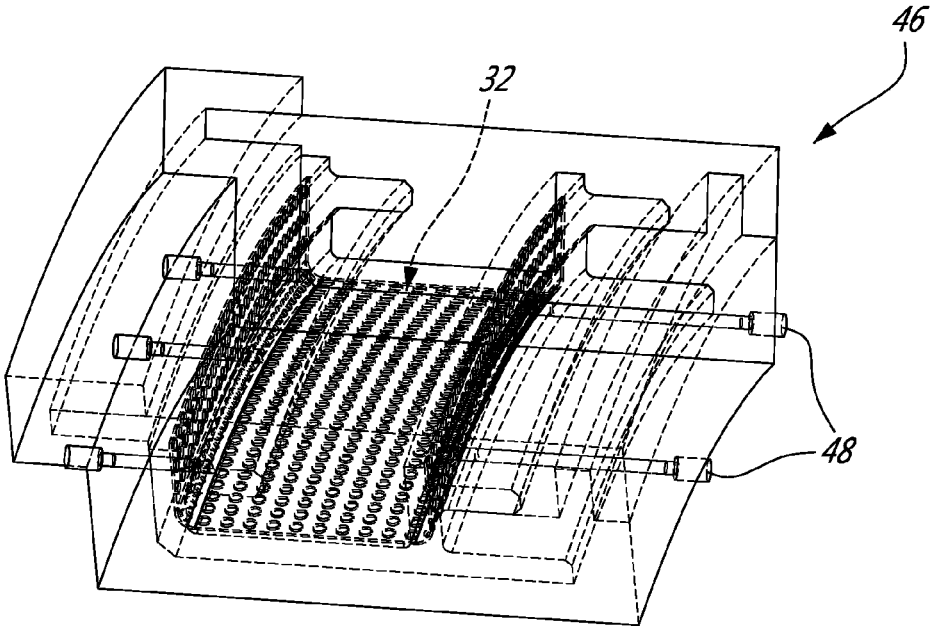
FIG. 4 a schematic isometric view illustrating the positioning of the metallic core in a metal injection mold.

As shown in FIG. 4, the preformed core 32 is positioned in an injection mold 46 including a plurality of mold details (only some of which are schematically shown in FIG. 4) adapted to be assembled together to define a mold cavity having a shape corresponding to the shape of the turbine shroud segment 20. The mold cavity is larger than that of the desired finished part to account for the shrinkage that will occur during debinding and sintering of the green shroud segment. Appropriate tooling, such as pins 48, can be engaged in the holes defined in the core 32 to hold the same in position in the mold 46. The same pins 48 can be used to create cooling holes in the MIM shroud body.

Figure 5:
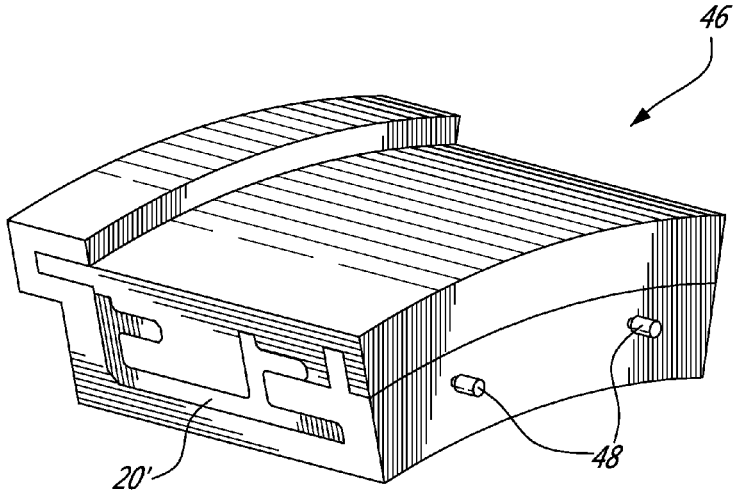
FIG. 5 is a schematic view illustrating a base metal powder mixture injected into the injection mold to form a (MIM) shroud segment body about the metallic core.

Once the core 32 has been properly positioned in the mold 46, a MIM feedstock comprising a mixture of metal powder and a binder is injected into the mold 46 to fill the mold cavity about the core 32, as schematically shown in FIG. 5. The MIM feedstock flows through the perforations define in the perforated sheet metal core 32, thereby allowing for a better attachment of the core 32 into the injected mass of MIM feedstock. In the finished product, the MIM material filling the perforations in the core 32 bridges the top and bottom layers of MIM material between which the core is held in sandwich, thereby rendering the composite component less subject to de-lamination problems when under load during engine running condition. The MIM feedstock may be a mixture of Nickel alloy powder and a wax binder. The metal powder can be selected from among a wide variety of metal powder, including, but not limited to Nickel alloys, Cobalt alloy, equiax single crystal. The binder can be selected from among a wide variety of binders, including, but not limited to waxes, polyolefins such as polyethylenes and polypropylenes, polystyrenes, polyvinyl chloride etc. Maximum operating temperature will influence the choice of metal type selection for the powder. Binder type remains relatively constant. Constraints for insert selection also include maximum operating temperature and MIM heat treatment temperatures (avoid using material for the insert that might affect mechanical properties during MIM heat treatment process).

The MIM feedstock is injected at a low temperature (e.g. at temperatures equal or inferior to 250 degrees Fahrenheit (121 deg. Celsius)) and at low pressure (e.g. at pressures equal or inferior to 100 psi (689 kPa)). The injection temperature is inferior to the melting point of the material selected to form the core 32. Injecting the feedstock at temperatures higher than the melting point of the core material would obviously damage the core 32. The feedstock is thus injected at a temperature at which the core 32 will remain chemically and physically stable. It is understood that the injection temperature is function of the composition of the feedstock. Typically, the feedstock is heated to temperatures slight higher than the melting point of the binder. However, depending of the viscosity of the mixture, the feedstock may be heated to temperatures that could be below or above melting point. The injection pressure is also selected so as to not compromise the integrity of the core 32. In other words, the core 32 must be designed to sustain the pressures typically involved in a MIM process. If the temperatures or the pressures were to be too high, the integrity of the core 32 could be compromised leading to defects in the final product.

Figure 6:
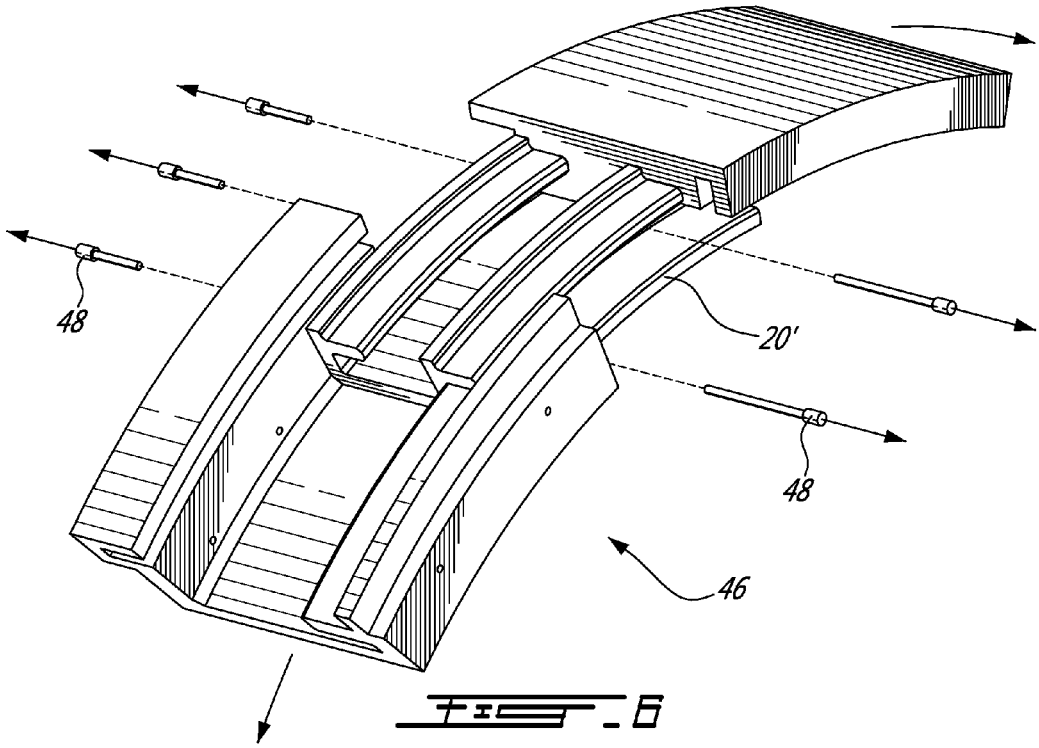
FIG. 6 is a schematic view illustrating how the mold details are disassembled to liberate the MIM shroud segment with the integrated/imbedded metallic core.

Once the feedstock is injected into the mold 46, it is allowed to solidify in the mold 46 to form a green compact around the core 32. After it has cooled down and solidified, the mold details are disassembled and the green shroud segment 20' with its embedded core 32 is removed from the mold 46, as shown in FIG. 6. The term "green" is used herein to generally refer to the state of a formed body made of sinterable powder or particulate material that has not yet been heat treated to the sintered state.

Next, the green shroud segment body 20' is debinded using solvent, thermal furnaces, catalytic process, a combination of these know methods or any other suitable methods. The resulting debinded part (commonly referred to as the "brown" part) is then sintered in a sintering furnace. The sintering temperature of the various metal powders is well-known in the art and can be determined by an artisan familiar with the powder metallurgy concept. It is understood that the sintering temperature is lower than the melting temperature of the material selected for the insert.

Next, the resulting sintered shroud segment body may be subjected to any appropriate metal conditioning or finishing treatments, such as grinding and/or coating.

The above described shroud manufacturing process has several advantages. The resulting composite construction of the shroud segment provides for a more robust design and offers greater resistance to damages. Indeed, the incorporation of a reinforcing layer or core in the platform 28 contributes to limit crack propagation through the platform 28. In this way, hot gas leakage through cracks in the platform can be avoided. The shroud segment is thus less subject to damages resulting from hot gas ingestion. Consequently, the shroud segment is expected to a have longer service life. Improving the integrity of the shroud segment also allows better controlling the blade tip clearance and thus avoiding engine performance losses.

The provision of a sheet metal core inside the platform may also allow optimizing/reducing the thickness of the shroud platform and, thus, provide weight savings. The designer may as well take advantage of the multilayer configuration of the platform to improve other characteristics of the shroud segment, such as containment capacity and creep/low cycle fatigue (LCF) resistance.

The above description is meant to be exemplary only, and one skilled in the art will recognize that changes may be made to the embodiments described without departing from the scope of the invention disclosed. For example, a wide variety of material combinations could be used for the core and the MIM shroud body. Also the core and the body of the shroud segment may adopt various configurations. For instance, the core could be provided in the form of a metallic grid or mesh. Still other modifications which fall within the scope of the present invention will be apparent to those skilled in the art, in light of a review of this disclosure, and such modifications are intended to fall within the appended claims.

The invention claimed is:

1. A turbine shroud segment for a turbine shroud of a gas turbine engine, the segment comprising a metal injection molded (MIM) shroud body, said MIM shroud body including a platform having a hot gas path side surface and a back side surface, the platform being axially defined from a leading edge to a trailing edge in a direction from an upstream position to a downstream position of a hot gas flow passing through the turbine shroud, and being circumferentially defined between opposite lateral sides of the platform, and forward and aft hooks extending from the back side surface of the platform, said forward and aft hooks being axially spaced-apart from each other; and a core imbedded in the MIM shroud body, said core having a platform reinforcing section extending longitudinally along a circumferential direction of the platform between said hot gas path and back side surfaces.

2. The turbine shroud segment defined in claim 1, wherein the core axially spans the platform between said forward and aft hooks, and wherein the core project into the forward and aft hooks.

3. The turbine shroud segment defined in claim 1, wherein the core comprises a sheet metal member.

4. The turbine shroud segment defined in claim 3, wherein the sheet metal member has a generally U-shaped section, including a forward leg extending into the forward hook of the MIM shroud body, an aft leg projecting into the aft hook of the MIM shroud body, and a web portion extending between said forward and aft legs, said web portion forming said substantially covering all of the surface area of the platform between the forward and aft hooks and forming at least in part said platform reinforcing section of the core.

5. The turbine shroud segment defined in claim 1, wherein the core is a sheet metal member.

6. The turbine shroud segment defined in claim 5, wherein the core is a perforated sheet metal member.

7. A method of manufacturing a turbine shroud segment for a gas turbine engine, the method comprising: providing a metallic core; holding the metallic core in position in a metal injection mold; and metal injection molding (MIM) a shroud segment body about the metallic core to form a composite metallic component, including injecting a metal powder mixture into the injection mold to imbed the metallic core into the shroud segment body and subjecting the composite component to debinding and sintering operations.

8. The method of claim 7, wherein the metallic core is provided in the form of a sheet metal member extending through a platform section of the shroud segment body, the sheet metal member providing and intermediate reinforcing layer between the opposed gas path and back side surfaces of the platform section.

9. The method of claim 7, wherein providing the metallic core comprises shaping a sheet metal member to have a generally U-shaped section including a platform reinforcing section and front and rear hook reinforcing sections extending longitudinally from opposed ends of the platform reinforcing section.

10. The method of claim 7, wherein providing a metallic core comprises forming the metallic core from a piece of perforated sheet metal.

11. The method of claim 7, wherein the metal powder mixture is injected at a temperature inferior to about 250 degree Fahrenheit and a pressure inferior to about 100 psi.

12. A shroud segment for a turbine shroud of a gas turbine engine, comprising a reinforced platform having a hot gas path side and a back side, the reinforced platform being axially defined from a leading edge to a trailing edge in a direction from an upstream position to a downstream position of a hot gas flow passing through a turbine section of the gas turbine engine, and being circumferentially defined between opposite lateral sides of the reinforced platform, the reinforced platform having a multilayer construction including an intermediate reinforcing layer comprising a sheet metal insert imbedded within the platform between said hot gas path side and back side.

13. The shroud segment defined in claim 12, wherein the sheet metal insert is imbedded in metal injection molded material.

14. The shroud segment defined in claim 13, wherein the sheet metal insert has a melting point equal to or inferior to that of the metal injection molded material.

15. The shroud segment defined in claim 12, wherein the sheet metal insert has a plurality of perforations extending therethrough.

16. The shroud segment defined in claim 12, wherein forward and aft hooks extend from the back side of the reinforced platform, and wherein the sheet metal insert has forward and aft legs respectively projecting into said forward and aft hooks.

* * * * *